United States Patent [19]

Hwang et al.

[11] Patent Number: 4,847,919

[45] Date of Patent: Jul. 18, 1989

[54] VENTILATION BAND

[76] Inventors: In M. Hwang; Yong K. Hwang, both of 301 N. School St., Mt. Prospect, Ill. 60056

[21] Appl. No.: 236,922

[22] Filed: Aug. 26, 1988

[51] Int. Cl.[4] ..... A41F 3/02

[52] U.S. Cl. ..... 2/338; 2/DIG. 1

[58] Field of Search ..... 2/181.2, 181.6, 182.3, 2/182.5, 220, 336, 337, 338

[56] References Cited

U.S. PATENT DOCUMENTS 130,173 8/1872 Young ..... 2/182.5 X
2,770,810 11/1956 De Grazia ..... 2/220
3,213,465 10/1965 Ludwikowski ..... 2/DIG. 1 X
3,296,626 1/1967 Ludwikowski ..... 2/DIG. 1 X

FOREIGN PATENT DOCUMENTS 855256 11/1960 United Kingdom ..... 2/338

*Primary Examiner*—Werner H. Schroeder
*Assistant Examiner*—Sara M. Current
*Attorney, Agent, or Firm*—Birch, Stewart, Kolasch & Birch

[57] ABSTRACT

A ventilation band for the human body which includes an outer cover, an inner rim, and a corrugated section between the interiors of the outer cover and the inner rim for forming a plurality of ventilation apertures to ventilate air and prevent the human body from pressing against the cloth being worn.

12 Claims, 1 Drawing Sheet

VENTILATION BAND

BACKGROUND OF THE INVENTION

1. Field of the Invention

The present invention relates to a ventilation band and more particularly, to an improved ventilation band which contains a corrugated section disposed between the interiors of an outer cover and an inner rim thereof for preventing the human body from being pressed by cloth near the belt, such as by underwear which is worn, thereby effectively ventilating the air along the human body therethrough.

2. Description of the Prior Art

Various underwear designs are well known. It is also known that such underwear has a plurality of apertures made of rigid or solid materials and such underwear is made of cotton to absorb sweat. However, disadvantages of these types of underwear made of cotton include pressure on the human body through the fastening band thereof causing it to fit tightly around the human body so that the air cannot ventilate. Also, such solid underwear is not comfortable for the human body and it is inconvenient to wear to work.

OBJECTS AND SUMMARY OF THE INVENTION

Accordingly, it is an object of the present invention to provide an improved band containing a corrugated section disposed between the interiors of an inner rim and an outer cover thereof.

Another object of the present invention is to provide a corrugated portion in the band for preventing the human body from being pressed by a fastening band of the underwear.

A further object of the present invention is to provide a ventilation band which contains an inner rim and an outer cover, and a corrugated section to form a plurality of apertures for effectively ventilating the air therethrough. Therefore, the ventilation band prevents sweat when the worker works in a hot work area such as, for example, in an iron and steel mill, cleaning factory, and the like.

Still another object of the present invention is to provide a ventilation band which has a plurality of aperture disposed therein so that the band forms a plurality of ventilation apertures when the ventilation band and the cloth are worn together.

Yet another object of the present invention is to provide a ventilation band which includes a small size inner rim covering a plurality of sharp edges of a corrugated section for preventing the sharp edges of the corrugated section from contacting from the human body and more comfortable fitting for the human body.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a ventilation band having a corrugated section disposed between the interiors of an inner rim and an outer cover to form a plurality of ventilation apertures for preventing the human body from being pressed by the cloth to easily ventilate the air therethrough.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
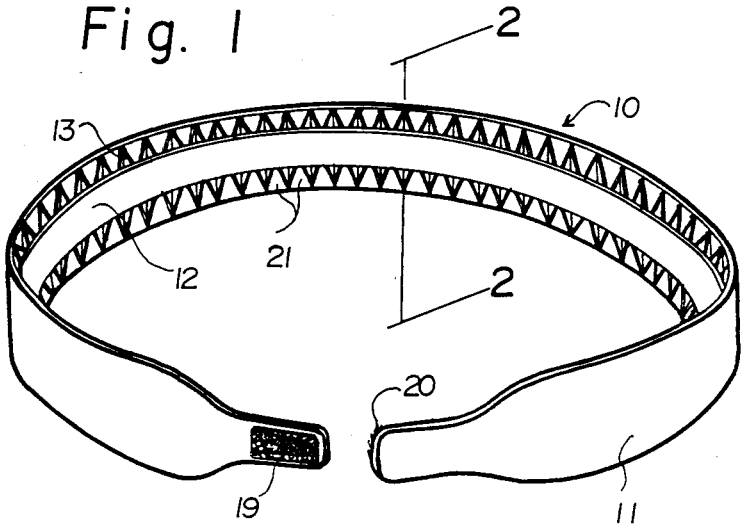
FIG. 1 is a perspective view of a ventilation band of the present invention.
Figure 3:
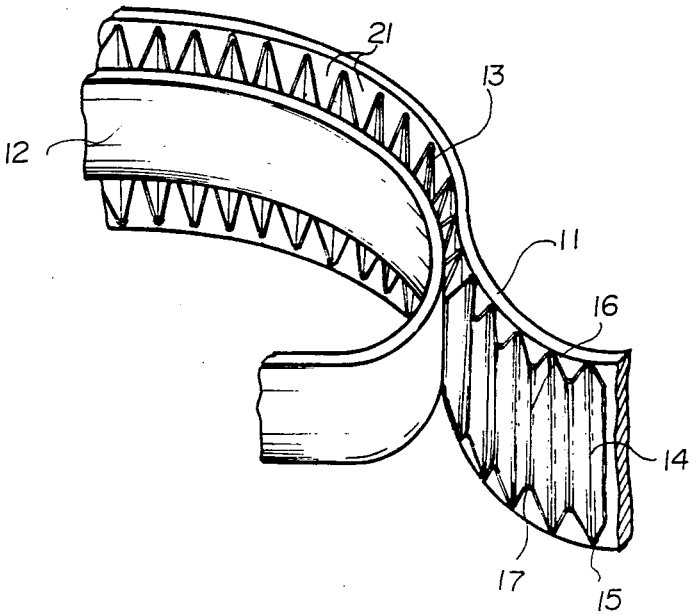
FIG. 3 is an exploded, perspective view of the ventilation band showing basic components of the present invention.

Referring now in detail to the drawings for the purpose of illustrating preferred embodiments of the present invention, the ventilation band 10 as shown in FIGS. 1 and 3 comprises an outer cover 11, an inner rim 12 as a pad, and a corrugated section 13 disposed between the interiors of the outer cover 11 and the inner rim 12 for forming a plurality of ventilation apertures 21 so that the air can be easily ventilated through the plurality of ventilation apertures 21.

Figure 2:
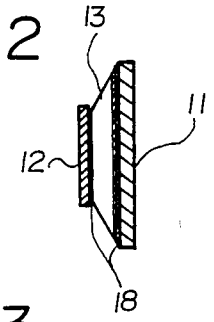
FIG. 2 is a cross-sectional view of FIG. 1, taken along line 2—2.

As shown in FIGS. 2 and 3, the corrugated section 13 includes a plurality of ridges 14 and its sharp edges 15 which are attached to the interior of the outer cover 11 by an adhesive 18 such as a glue. Also, the corrugated section 13 includes a plurality of valleys 16 and its round configuration edges 17 are attached to the interior of the inner rim 12 by an adhesive 18 such as a glue. At this time, the corrugated section 13 is cut at one side thereof. That is, the cut side including the plurality of valleys 16 is smaller than non-cut side including the plurality of ridges 14 (FIG. 2). The width between the ridges 14 and the valleys 16 is about ⅛ inches to 3/16 inches (3–5 mm). And the width of the inner rim 12 is little larger than that of the valleys 16 so that the plurality of sharp edges 17 is covered by the inner rim 13 for preventing the human body from being pricked by the edges 17.

The outer cover 11 is made of polyester, cloth, or the like. The inner rim 12 is made of latex sponge, rubber sponge, or the like and the corrugated section 13 is made of hard plastic such as a polyethylene. Generally, the thickness of the pad 12 is thin and the thickness of the outer cover 11 is thick. The corrugated section 13 can be attached to the interior of the outer cover 11 and inner rim 12 by the adhesive 18 (FIG. 2). The adhesive is a glue, chemical adhesive, or the like.

The ventilation band 10 is provided with a fastener (Velcro) disposed at both ends thereof which is a locking-type Velcro as shown in FIG. 1, is composed of a loop portion 19 and a hook portion 20. Generally, as the fastener any conventional fastening device such as a buckle or the like can be used.

The ventilation band 10 of the present invention is used between the human body and the underwear, the underwear and the pants, and the human body and the pants. It is better for the workers who work in a hot area such as an iron and steel mill, cleaning factory, and the like particularly, in the summer. Also, the ventilation band 10 of the present invention can be attached near the belt area of the pants or a suitable portion of the underwear.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A ventilation band for the human body comprising:

an outer cover of said ventilation band, an inner rim of said ventilation band, said inner rim having a smaller width than the width of said outer cover, and a corrugated section disposed between the interiors of said outer cover and said inner cover, said corrugated section having a plurality of ridges and valleys wherein the length of said valleys is shorter than that of said ridges whereby when the ventilation band is worn, the ventilation band prevents the human body from being pressed against the cloth which is worn thereby effectively ventilating the air therethrough to prevent sweating when the user works in hot area.

2. The ventilation band of claim 1, wherein the corrugated section is attached to the interiors of the outer cover and inner rim by an adhesive resectively.

3. The ventilation band of claim 2, wherein the ahesive is a glue.

4. The ventilation band of claim 1, wherein the ridges and valleys are provided with a round configurated edges, respectively.

5. The ventilation band of claim 4, wherein the width between the ridges and valleys is about $\frac{1}{8}$ inches to 3/16 inches.

6. The ventilation band of claim 1, wherein one end of the outer cover is provided with a loop type Velcro portion and the opposite end of the inner rim is provided with a hook type Velcro portion for locking the ventilation band to the human body.

7. The ventilation band of claim 1, wherein the outer cover is made of polyester.

8. The ventilation band of claim 7, wherein the outer cover is made of cloth.

9. The ventilation band of claim 1, wherein the inner rim is made of latex sponge.

10. The ventilation band of claim 9, wherein the inner rim is made of rubber sponge.

11. The ventilation band of claim 1, wherein the corrugated section is made of plastic.

12. The ventilation band of claim 11, wherein the corrugated section is made of polyethylene.

* * * * *